US008985752B2

(12) United States Patent
Ishizawa et al.

(10) Patent No.: US 8,985,752 B2
(45) Date of Patent: Mar. 24, 2015

(54) METHOD OF REFILLING LIQUID, LIQUID CONTAINER, AND METHOD OF MANUFACTURING A LIQUID CONTAINER

(71) Applicant: Seiko Epson Corporation, Tokyo (JP)

(72) Inventors: Taku Ishizawa, Nagano (JP); Hiroyuki Kawate, Yamanashi (JP); Hiroshi Nose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/753,675

(22) Filed: Jan. 30, 2013

(65) Prior Publication Data

US 2013/0321538 A1 Dec. 5, 2013

(30) Foreign Application Priority Data

May 31, 2012 (JP) ..... 2012-124138

(51) Int. Cl.
*B41J 2/175* (2006.01)

(52) U.S. Cl.
CPC ..... *B41J 2/17506* (2013.01)
USPC ..... 347/86; 347/7; 347/19; 347/84; 347/85

(58) Field of Classification Search
CPC .... B41J 2/17566; B41J 2/17513; B41J 2/175; B41J 2/17553; B41J 2/17506
See application file for complete search history.

(56) References Cited

U.S. PATENT DOCUMENTS

| | | | |
|---|---|---|---|
| 7,942,510 | B2 | 5/2011 | Shinada et al. |
| 8,142,000 | B2 | 3/2012 | Ishizawa et al. |
| 8,177,342 | B2 | 5/2012 | Wanibe et al. |
| 2007/0046742 | A1 | 3/2007 | Inoue |
| 2008/0230141 | A1 | 9/2008 | Hattori |
| 2010/0073438 | A1 | 3/2010 | Wanibe et al. |

FOREIGN PATENT DOCUMENTS

| | | | |
|---|---|---|---|
| CN | 201067997 | Y | 6/2008 |
| JP | 09-174870 | A | 7/1997 |
| JP | 2008-044193 | A | 2/2008 |
| JP | 2010-005956 | A | 1/2010 |
| JP | 2010-005957 | A | 1/2010 |
| JP | 2010-005958 | A | 1/2010 |

OTHER PUBLICATIONS

The Extended European Search Report for the corresponding European Patent Application No. 13169934.0 dated Dec. 5, 2014.

*Primary Examiner* — Justin Seo
(74) *Attorney, Agent, or Firm* — Global IP Counselors, LLP

(57) ABSTRACT

A method of refilling ink in an ink cartridge includes refilling the ink in the ink cartridge from a position at which a translucent part is provided in the ink cartridge, with the translucent part being used to optically detect an amount of the ink held in the ink cartridge.

9 Claims, 4 Drawing Sheets

METHOD OF REFILLING LIQUID, LIQUID CONTAINER, AND METHOD OF MANUFACTURING A LIQUID CONTAINER

CROSS-REFERENCE TO RELATED APPLICATIONS

Under 35 USC §119 of U.S. Patent Law, this application claims priority to Japanese Patent Application No. 2012-124138, filed on May 31, 2012, the entirety of which is incorporated herein by reference.

BACKGROUND

1. Technical Field

The present invention relates to a method of refilling ink, an ink cartridge, and a method of manufacturing an ink cartridge.

2. Related Art

In a conventional inkjet printer, ink inside an ink cartridge is consumed, and when none remains, the ink cartridge is replaced with a new ink cartridge. However, the act of discarding a used ink cartridge after one usage leads to problems such as an increase in waste matter and an impact on the environment, and thus attempts have been made to refill a used ink cartridge with ink and reuse the ink cartridge. For example, in Japanese Laid-open Patent Publication No. 2010-005958, a through hole is opened in a lid member of an ink cartridge to allow for ink to be refilled from the through hole. In Japanese Laid-open Patent Publication No. 2008-044193, the lid member is removed from the ink cartridge, and a hole is opened in a part of a film that is welded onto the body of the ink cartridge, to allow for ink to be refilled from the hole.

However, in the case of Japanese Laid-open Patent Publication No. 2010-005958, since the ink is refilled from the through hole opened in the lid member, the status of the filling of the ink cartridge with the ink cannot be checked when the filling is being carried out. In the case of Japanese Laid-open Patent Publication No. 2008-044193, even though the status of the filling of the ink can be checked through the welded film, tasks such as removing and later re-attaching the lid member become necessary, because the lid member is removed from the ink cartridge and the hole is opened in the film, and it is difficult to refill the ink in a short period of time without considerable effort.

SUMMARY

The present invention has been contrived in order to resolve the foregoing problems at least in part, and can be implemented as the following modes or aspects.

According to one aspect, a method of refilling ink, in which an ink cartridge is refilled with ink, the method being characterized in that a translucent part that is used in order to optically detect the amount of ink held in the ink cartridge is provided to the ink cartridge, and the refilling of the ink is carried out from a position at which the translucent part is provided.

According to the foregoing method of refilling ink, the translucent part of the ink cartridge which is used in order to optically detect the amount of ink is utilized to refill the ink. This makes it possible to carry out the refilling while also checking the status of the refilling of the ink cartridge with the ink, via the translucent part. As a result, there will be fewer work mistakes during the refilling of the ink, and the refilling can be reliably carried out. Also, the need for tasks such as removing and re-attaching the lid member is obviated, and the ink can be refilled in a short period of time without considerable effort.

In the foregoing method of refilling ink, the ink cartridge preferably has a plurality of ink holding chambers in which ink is held, and the translucent part is provided the ink holding chamber having the greatest volume of the plurality of ink holding chambers.

According to the foregoing method of refilling ink, the translucent part is provided to the ink holding chamber having the greatest volume of the plurality of ink holding chambers. This makes it possible to fill the entire ink cartridge while also checking the state of filling the ink holding chamber having the greatest volume with the ink, and makes it possible to efficiently carry out the task of refilling the ink.

In the foregoing method of refilling ink, the translucent part pereferably has: a first translucent part comprising a prism whereby the state of reflection of light incident from the exterior of the ink cartridge varies depending on the amount of ink held in the ink cartridge; and a second translucent part comprising a member that allows light to pass through; a through hole that penetrates through the second translucent part being formed, and the ink being refilled from the through hole.

According to the foregoing method of refilling ink, the amount of ink held in the ink cartridge can be optically detected on the basis of the change in the state of reflection of the light incident on the prism constituting the first translucent part. It is also possible to check the state of the filling of the ink, via a portion of the translucent part other than the through hole, when the ink is being refilled from the through hole formed in the second translucent part.

In the foregoing method of refilling ink, after the ink cartridge has been refilled with the ink, the through hole is preferably sealed by a member that absorbs light.

According to the foregoing method of refilling ink, after the ink has been refilled, the through hole is sealed by a member that absorbs light. Because the member absorbs light, it is possible to curb the undesirable effects of reflected light from the member by which the through hole has been sealed when the amount of ink is being optically detected. As a result, the accuracy of detecting the amount of ink can be enhanced.

In the foregoing method of refilling ink, the translucent part preferably has: a first translucent part comprising a prism whereby the state of reflection of light incident from the exterior of the ink cartridge varies depending on the amount of ink held in the ink cartridge; and a second translucent part comprising a member that allows light to pass through; a through hole that penetrates through the first translucent part being formed, and the ink being refilled from the through hole.

According to the foregoing method of refilling ink, since the through hole is formed in the prism constituting the first translucent part, it is no longer possible to detect the amount of ink held in the ink cartridge by utilizing the prism. However, the state of the filling of the ink is easier to see and can be checked via the entirety of the second translucent part when the ink is being refilled from the through hole of the first translucent part.

In the foregoing method of refilling ink, the translucent part is preferably removed from the ink cartridge, and the ink is refilled from an opening part formed by removing the translucent part.

According to the foregoing method of refilling ink, the ink is refilled from an opening part formed by removing the translucent part. This makes it possible to readily provide accommodation merely by removing the translucent part, without needing to form the through hole in the ink cartridge. It is also possible to avoid entry of boring debris into the interior of the ink cartridge, the boring debris being generated in a case where the ink cartridge is bored to form the through hole.

In the foregoing method of refilling ink, the ink cartridge is preferably constituted of a black-colored material.

According to the foregoing method of refilling ink, the ink cartridge is constituted of a black-colored material. For this reason, light that is incident on the ink cartridge is more readily absorbed. This makes it possible to curb the undesirable effects of reflected light from the ink cartridge when the amount of ink is being optically detected. As a result, the accuracy of detecting the amount of ink can be enhanced. The translucent part or the like can also be readily laser-welded to the ink cartridge.

In the foregoing method of refilling ink, the first translucent part and the second translucent part are preferably not in contact with each other.

According to the foregoing method of refilling ink, the second translucent part is provided to a place on the ink cartridge that is different than that of the prism constituting the first translucent part. This makes it possible to check the state of the filling of the ink at a place different than that of the prism, via the second translucent part.

According to another aspect, an ink cartridge has been refilled by the foregoing method of refilling ink.

According to the foregoing ink cartridge, a higher-quality ink cartridge can be provided, due to the fact that work errors during the refilling of the ink are curbed.

According to another aspect, an ink cartridge is manufactured by refilling the ink cartridge by the foregoing method of refilling ink.

According to the foregoing method of manufacturing an ink cartridge, a high-quality ink cartridge can be produced, due to the fact that work errors during the refilling of the ink are curbed.

DESCRIPTION OF EXEMPLARY EMBODIMENTS

First Embodiment

A method of refilling ink as in the first embodiment shall be described below, with reference to the accompanying drawings.

Configuration of Ink Cartridge

Figure 1:
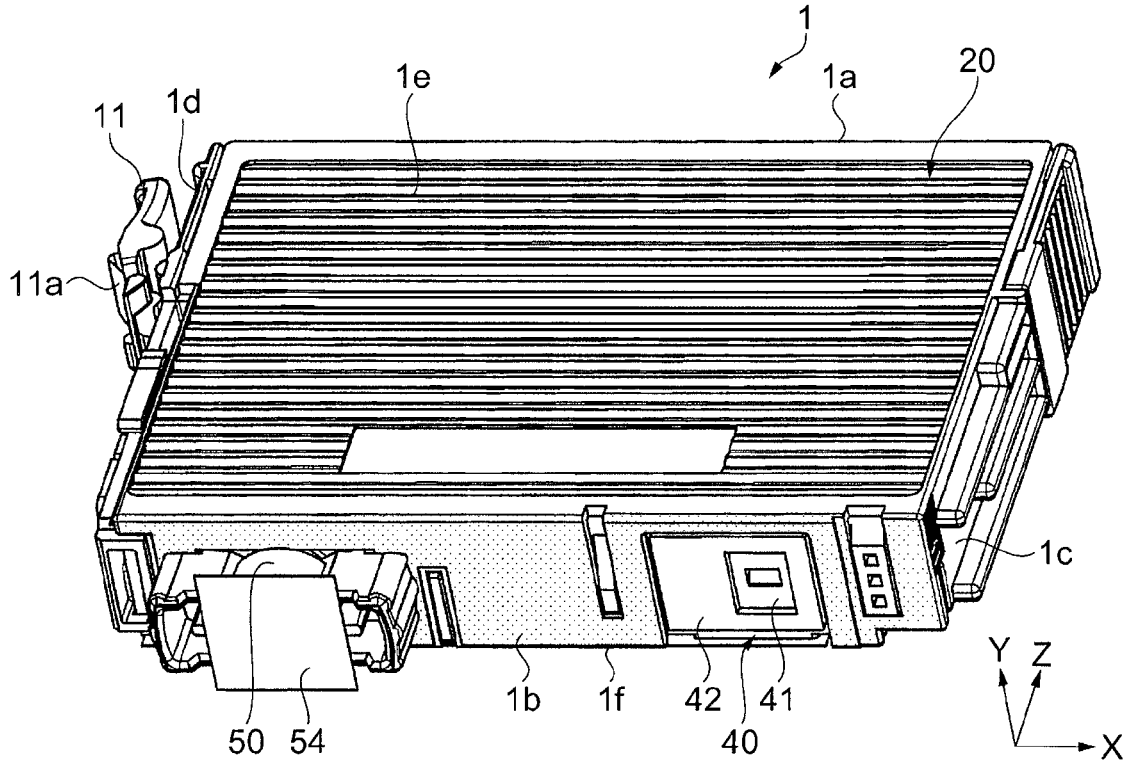
FIG. 1 is an external perspective view of an ink cartridge.
Figure 2:
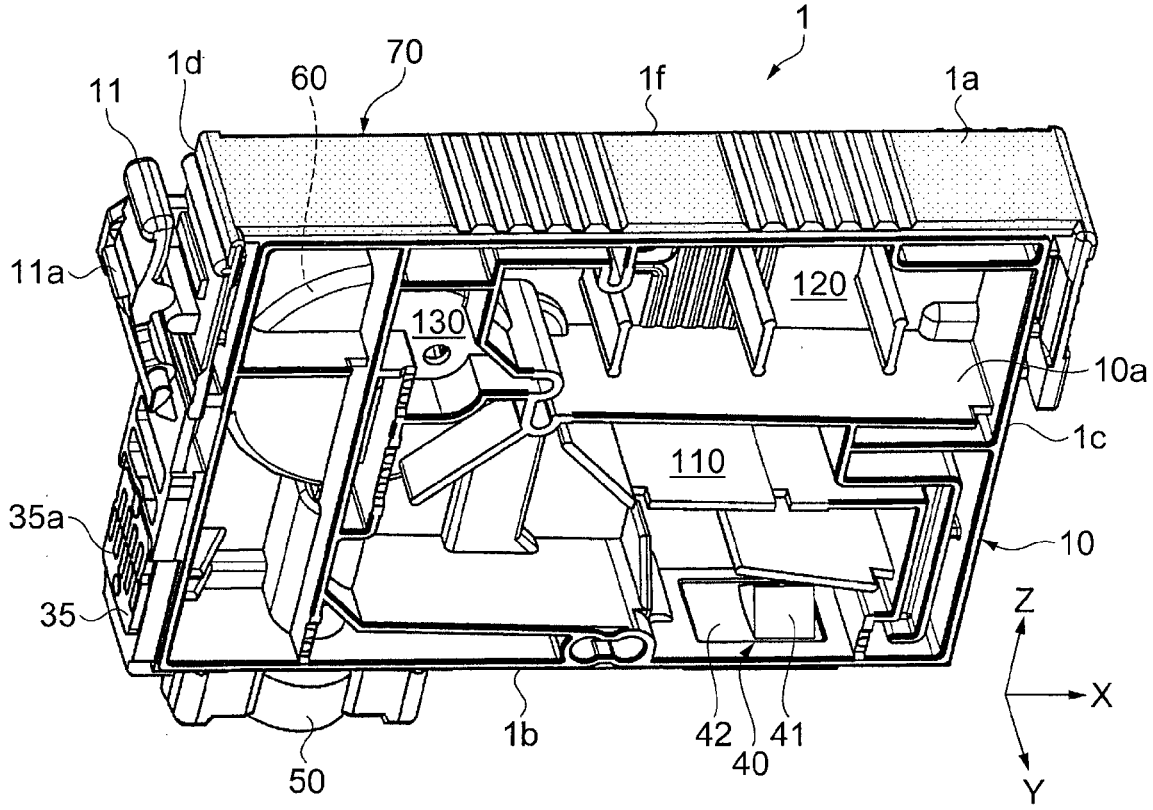
FIG. 2 is an external perspective view illustrating an internal structure of an ink cartridge.

FIG. 1 is an external perspective view of an ink cartridge 1, which is furnished in order to apply the method of refilling ink as in the present embodiment. FIG. 2 is an external perspective view illustrating an internal structure of the ink cartridge 1. In the following drawings, X-, Y-, and Z-axes for specifying directions are depicted.

The ink cartridge 1 holds a liquid (ink) in the interior. The ink cartridge 1 is mounted onto a carriage (not shown) provided to an inkjet printer, and supplies the ink to the inkjet printer.

As illustrated in FIG. 1, the ink cartridge 1 has a substantially rectangular cuboid shape, and includes a surface 1*a* in the positive direction of the Z-axis, a surface 1*b* in the negative direction of the Z-axis, a surface 1*c* in the positive direction of the X-axis, a surface 1*d* in the negative direction of the X-axis, a surface 1*e* in the positive direction of the Y-axis, and a surface 1*f* in the negative direction of the Y-axis. Hereinbelow, for the sake of convenience of explanation, the surface 1*a*, the surface 1*b*, the surface 1*c*, the surface 1*d*, the surface 1*e*, and the surface 1*f* are also called an upper surface 1*a*, a bottom surface 1*b*, a right-side surface 1*c*, a left-side surface 1*d*, a front surface 1*e*, and a back surface 1*f*, respectively. Further, the sides where the surfaces 1*a* to 1*f* are present are also called an upper surface side, a bottom surface side, a right-side surface side, a left-side surface side, a front surface side, and a back surface side, respectively.

Provided to the bottom surface 1*b* is an ink supply unit 50 having a supply hole for supplying the ink to the inkjet printer. The ink supply unit 50 has an opening part that is sealed by a sealing film 54. The sealing film 54 is adapted so as to be broken by an ink supply needle (not shown), provided to the carriage, when the ink cartridge 1 is mounted onto the carriage of the inkjet printer.

An engaging lever 11 is provided to the left-side surface 1*d*. A projection 11*a* is formed in the engaging lever 11. When the ink cartridge 1 is being mounted onto the carriage of the inkjet printer, the projection 11*a* engages with a recess (not shown) formed in the carriage, whereby the ink cartridge 1 is fixed to the carriage. During printing of the inkjet printer, the carriage becomes integrated with a print head (not shown) and is moved reciprocatingly in a sheet width direction (main scanning direction) of a print medium. A circuit board 35 is provided below the engaging lever 11. A plurality of electrode terminals 35*a* are disposed atop the circuit board 35, and the electrode terminals 35*a* are electrically connected to the inkjet printer via an electrode terminal (not shown) that is disposed on the carriage. A writable non-volatile memory, such as an Electronically Erasable and Programmable Read Only Memory (EEPROM), is provided to the circuit board 35, and information relating to the ink, such as information on the amount of ink consumed by the inkjet printer, is recorded.

An outer surface film 70 is bonded to the upper surface 1*a* and the back surface 1*f* of the ink cartridge 1. The ink cartridge 1 also has a cartridge body 10 and a lid member 20 for covering a front surface side (the front surface 1*e* side) of the cartridge body 10. Ribs 10*a* having various shapes are formed in the interior of the front surface side of the ink cartridge 1. Between the cartridge body 10 and the lid member 20, a film (not shown) for covering the front surface side of the cartridge body 10 is provided. The film for covering the front surface side is bonded precisely to an end surface of the front surface side of the ribs 10*a* of the cartridge body 10 so that no gap exists. The ribs 10*a* and the film for covering the front surface side divide the interior of the ink cartridge 1 to form a plurality of small chambers, such as an ink holding chamber 110, an ink holding chamber 120, and a buffer chamber 130.

The ink holding chamber 110, the ink holding chamber 120, and the buffer chamber 130 each communicate to an ink flow path (not shown) formed on a back surface side (the back surface 1*f* side) of the cartridge body 10, via a through hole penetrating through the cartridge body 10 in the thickness direction; via this ink flow path, the ink is permitted to move between the ink holding chambers.

The ink holding chamber 110 is an ink holding chamber to which ink that is stored in the ink holding chamber 120 is introduced. The ink holding chamber 110 is an ink holding region which has the greatest volume of the ink holding chambers, formed on the front surface side of the cartridge body 10, and is formed in a lower portion from substantially half of the cartridge body 10. The ink holding chamber 120 is the farthest upstream ink holding chamber in the cartridge body 10, and is formed in an upper portion from substantially half of the front surface side of the cartridge body 10. The buffer chamber 130 is a small chamber divided by the ribs 10*a* and formed between the ink holding chamber 120 and the ink holding chamber 110, and is formed as an ink storage space just before a differential pressure regulating valve 60 on the back surface side of the cartridge body 10.

The differential pressure regulating valve 60 is adapted to lower the pressure on the downstream side with respect to the upstream side, whereby the ink being supplied to the ink supply unit 50 has a negative pressure. The ink flowing into the differential pressure regulating valve 60 is guided to the downstream side by the differential pressure regulating valve 60; via the ink supply needle, which has been inserted into the ink supply unit 50, the ink is supplied to the inkjet printer.

A prism unit 40 (translucent part) which is used in order to optically detect the remaining ink amount status of the ink holding chamber 110 is provided to the bottom surface 1*b* of the ink cartridge 1. The prism unit 40 is constituted of a translucent member which is formed of a synthetic resin, such as, for example, polypropylene, and allows light to pass through. The prism unit 40 is provided with a prism 41 (first translucent part) of a right-angled isosceles triangular prism shape, and a planar base part 42 (second transparent part) to which the prism 41 is attached. The prism 41 is attached to a portion that is substantially half in the lengthwise direction of the base part 42. The prism unit 40 is attached to the bottom surface 1*b* by, for example, laser welding, so that the prism 41 is located inside of the ink holding chamber 110.

Herein, the word "translucent" may refer to being semi-translucent, and should allow for it to be determined that there is ink with an optical sensor provided to the inkjet printer side when an unused ink cartridge is being mounted onto the inkjet printer for printing.

The light-reflecting state of the prism 41 changes depending on the refractive index of a fluid (ink or air) in contact therewith. In the process of detecting the remaining ink amount status, light is emitted toward the prism 41 from an optical sensor (not shown) provided to the inkjet printer. In the inkjet printer, the optical sensor takes in reflected light from the prism 41, and the remaining ink amount status is detected on the basis of the amount of reflected light that is taken in.

In the present embodiment, the upper surface 1*a*, the bottom surface 1*b*, the right-side surface 1*c*, the left-side surface 1*d*, the front surface 1*e*, and the back surface 1*f* of the ink cartridge 1 are constituted of a black-colored material. Because the surfaces of the ink cartridge 1 are black in color, the prism unit 40 and the like can be easily laser-welded. Also, because the bottom surface 1*b* is black in color, the light irradiated from the optical sensor in the process of detecting the remaining ink amount status is more easily absorbed by the bottom surface 1*b*. As a result, with the optical sensor, light other than the reflected light from the prism 41 can be prevented from being received, and the precision of detecting the remaining ink amount status can be enhanced.

Method of Refilling Ink

The following describes the method of refilling the ink cartridge 1 with ink.

Figure 3A:
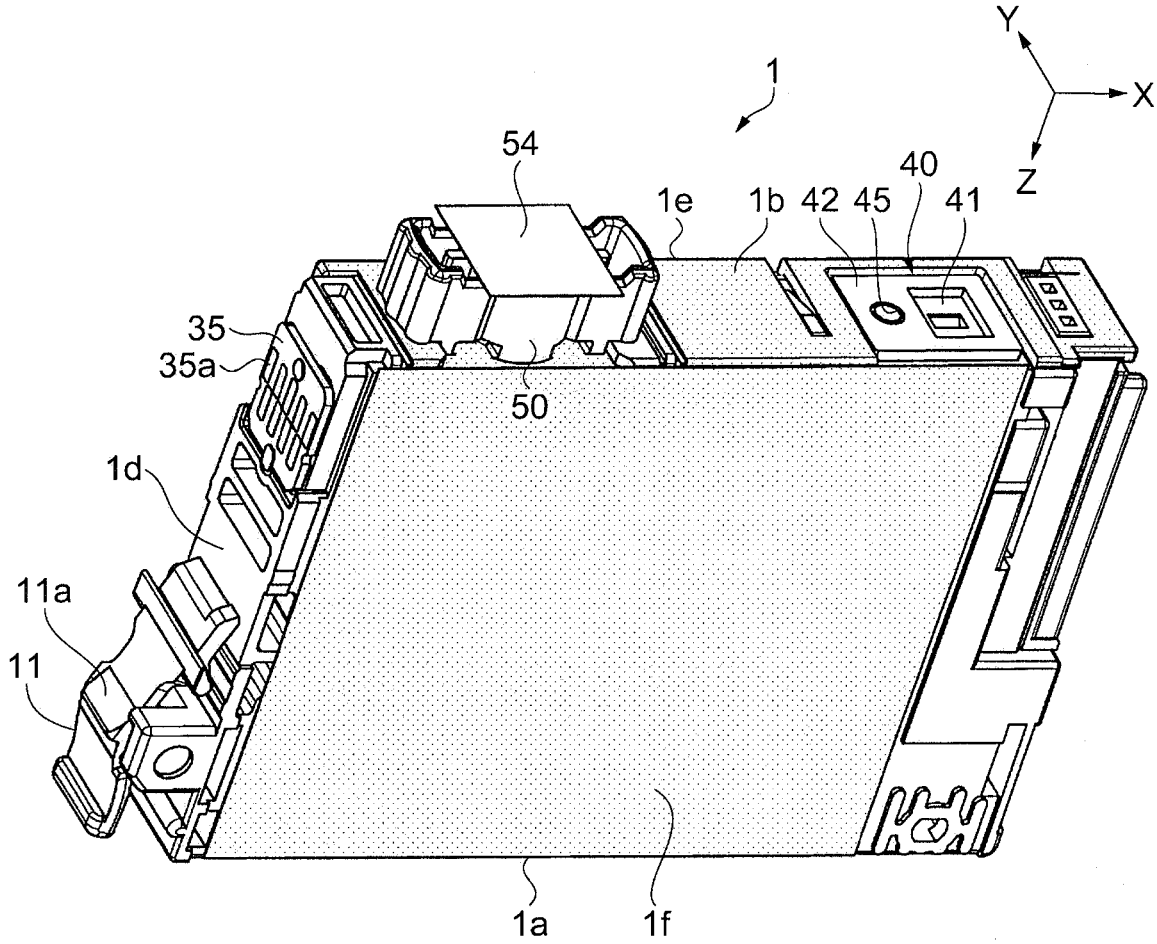
FIG. 3A is an external perspective view of an ink cartridge during ink refilling in a first embodiment.
Figure 3B:
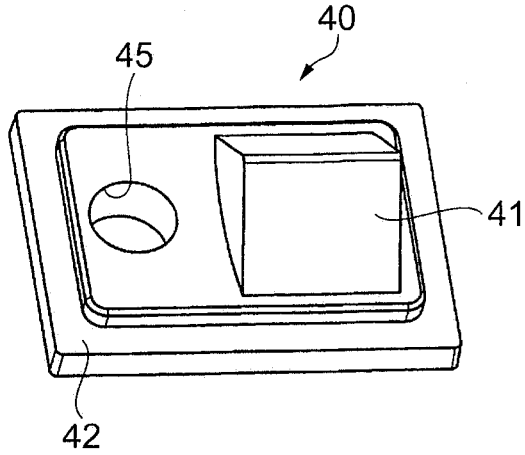
FIG. 3B is an enlarged view of a prism unit during ink refilling.

FIG. 3A is an external perspective view of the ink cartridge 1 during ink refilling. In FIG. 3A, the ink cartridge 1 illustrated in FIG. 1 has been placed vertically inverted, the bottom surface 1*b* being located at the upper side of FIG. 3A and the upper surface 1*a* being located at the lower side. As illustrated in FIG. 3A, a through hole 45 is formed in the base part 42 of the prism unit 40 provided to the bottom surface 1*b*. The through hole 45 is formed by, for example, drilling or the like. FIG. 3B is an enlarged view of the prism unit 40 during ink refilling. FIG. 3B illustrates a view where the prism unit 40 is viewed from the direction of the apex of the prism 41, i.e., from the inside of the ink holding chamber 110 of the ink cartridge 1. The through hole 45 illustrated in FIG. 3B creates communication between the ink holding chamber 110 and the exterior of the ink cartridge 1.

When the ink cartridge 1 is being refilled with ink, then, for example, a tube for ink injection is inserted into the through hole 45 formed in the base part 42 of the prism unit 40. The inside of the ink cartridge 1 is then filled with ink by injecting the ink into the ink holding chamber 110 from the through hole 45.

When the refilling of the ink cartridge 1 with the ink is concluded, the through hole 45 formed in the base part 42 is sealed. The through hole 45 is sealed by inserting an elastic sealing member made of, for example, a resin, rubber, elastomer, or the like. This makes it possible for the through hole 45 to be reliably sealed, and possible to refill with ink a plurality of times by again removing the sealing member from the through hole 45.

Additionally, information on the amount of ink consumed in the non-volatile memory provided to the circuit board 35 of the ink cartridge 1 is rewritten to an available value. Rather than the information in the non-volatile memory being rewritten, instead the information on the amount of ink consumed may be rendered into an available value by replacing the non-volatile memory.

In the embodiment described above, the through hole 45 is formed in the base part 42 of the prism unit 40 which is used in order to detect the remaining ink amount status when the ink cartridge 1 is being refilled with ink. The ink cartridge 1 is refilled by injecting the ink from the through hole 45. At this time, a user who is carrying out the task of refilling the ink is able to visually check the status of the ink filling via a translucent portion of the prism unit 40 other than the through hole 45. This makes it possible to reduce work mistakes in the task of refilling the ink, for example, when ink overflows out of the ink cartridge 1, or when the amount of ink refilled is not sufficient to reach a prescribed amount, and further makes it possible for the ink to be refilled efficiently and reliably. Because the prism unit 40 is provided to the ink holding chamber 110, which has the greatest volume of the ink holding chambers, the status of the filling of the ink cartridge overall can be easily checked.

Second Embodiment

A method of refilling ink as in the second embodiment shall be described below, with reference to the accompanying drawings.

Figure 4A:
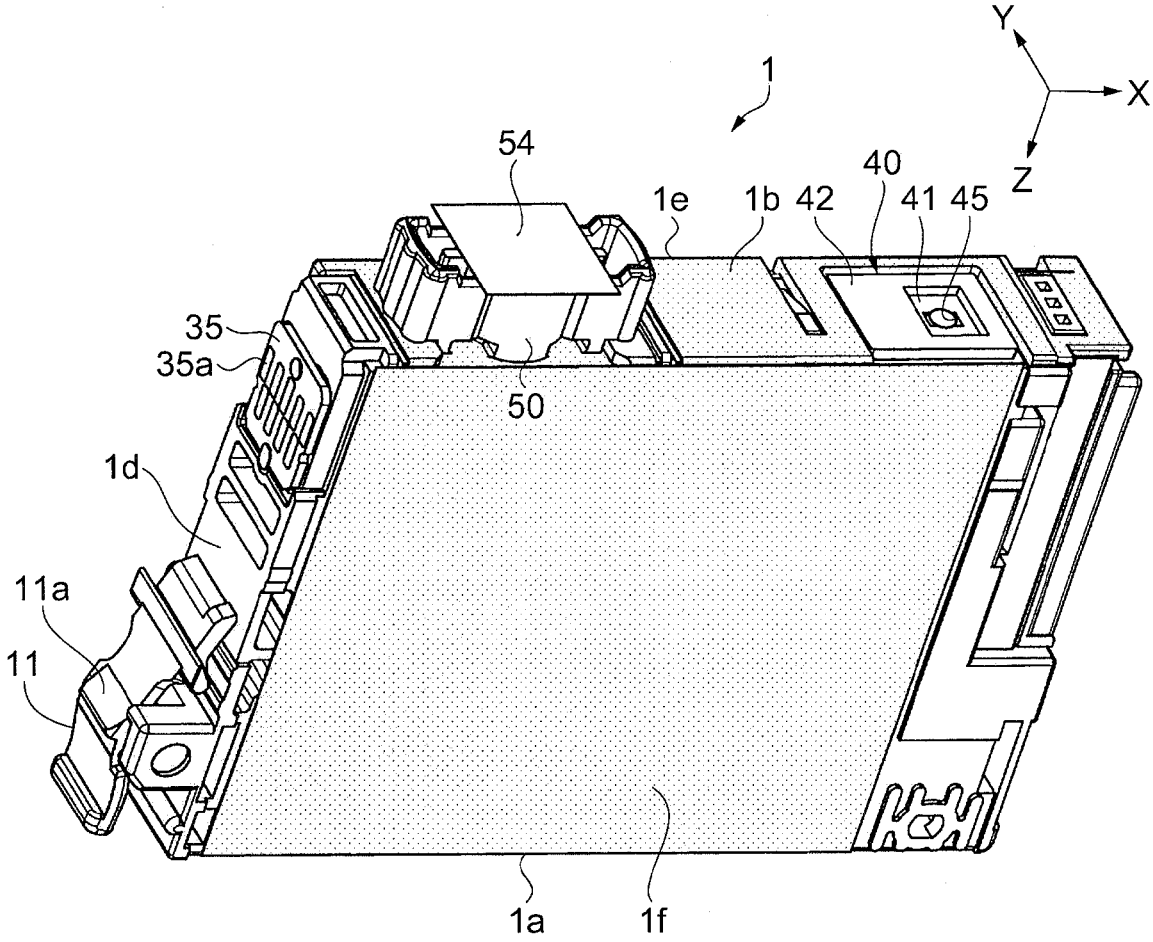
FIG. 4A is an external perspective view of an ink cartridge during ink refilling in a second embodiment.
Figure 4B:
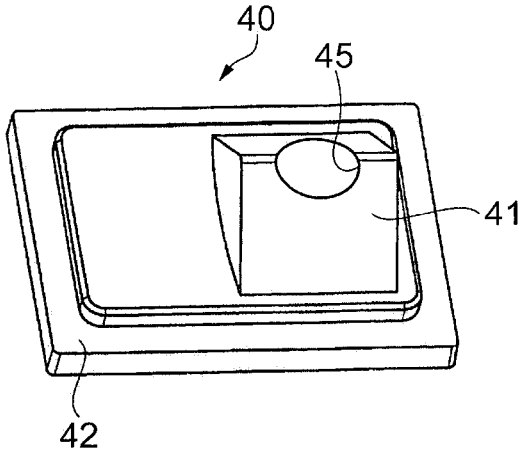
FIG. 4B is an enlarged view of a prism unit during ink refilling in the second embodiment.

FIG. 4A is an external perspective view of the ink cartridge 1 during ink refilling in the second embodiment. FIG. 4B is an enlarged view of the prism unit 40 during ink refilling in the second embodiment. Similarly with respect to FIG. 3B, FIG. 4B illustrates a view where the prism unit 40 is seen from the direction of the apex of the prism 41, i.e., from inside the ink holding chamber 110 of the ink cartridge 1. As illustrated in FIGS. 4A and 4B, in the second embodiment, unlike in the first embodiment, the through hole 45 is formed not in the base part 42 of the prism unit 40 but rather in the prism 41.

When the ink cartridge 1 is being refilled with ink, for example, a tube for ink injection is inserted into the through hole 45 formed in the prism 41 of the prism unit 40. The inside of the ink cartridge 1 is then filled with ink by injecting the ink into the ink holding chamber 110 from the through hole 45.

When the refilling of the ink cartridge 1 with the ink is concluded, the through hole 45 formed in the prism 41 is sealed with a sealing member similar to that used in the first embodiment. This makes it possible for the through hole 45 to be reliably sealed, and possible to refill with ink a plurality of times by again removing the sealing member from the through hole 45.

In the embodiment described above, the through hole 45 is formed in the prism 41 of the prism unit 40 which is used in order to detect the remaining ink amount status when the ink cartridge 1 is being refilled with ink. The ink cartridge 1 is refilled by injecting the ink from the through hole 45. At this time, a user who is carrying out the task of refilling the ink is able to visually check the status of the ink filling via a translucent portion of the prism unit 40 other than the through hole 45. Herein, because in the first embodiment the through hole 45 is formed in the base part 42, the remaining ink amount status can be detected by using the prism 41 after the ink has been refilled, but in the second embodiment, the through hole 45 is formed in the prism 41, and thus it is no longer possible to detect the remaining ink amount status by using the prism 41 after the ink has been refilled. However, in the second embodiment, the fact that the through hole 45 is not formed in the base part 42 makes it possible to view the status of the ink filling via a translucent portion that is larger than in the first embodiment, and thus checking is easier.

Third Embodiment

A method of refilling ink as in the third embodiment shall be described below, with reference to the accompanying drawings.

Figure 5A:
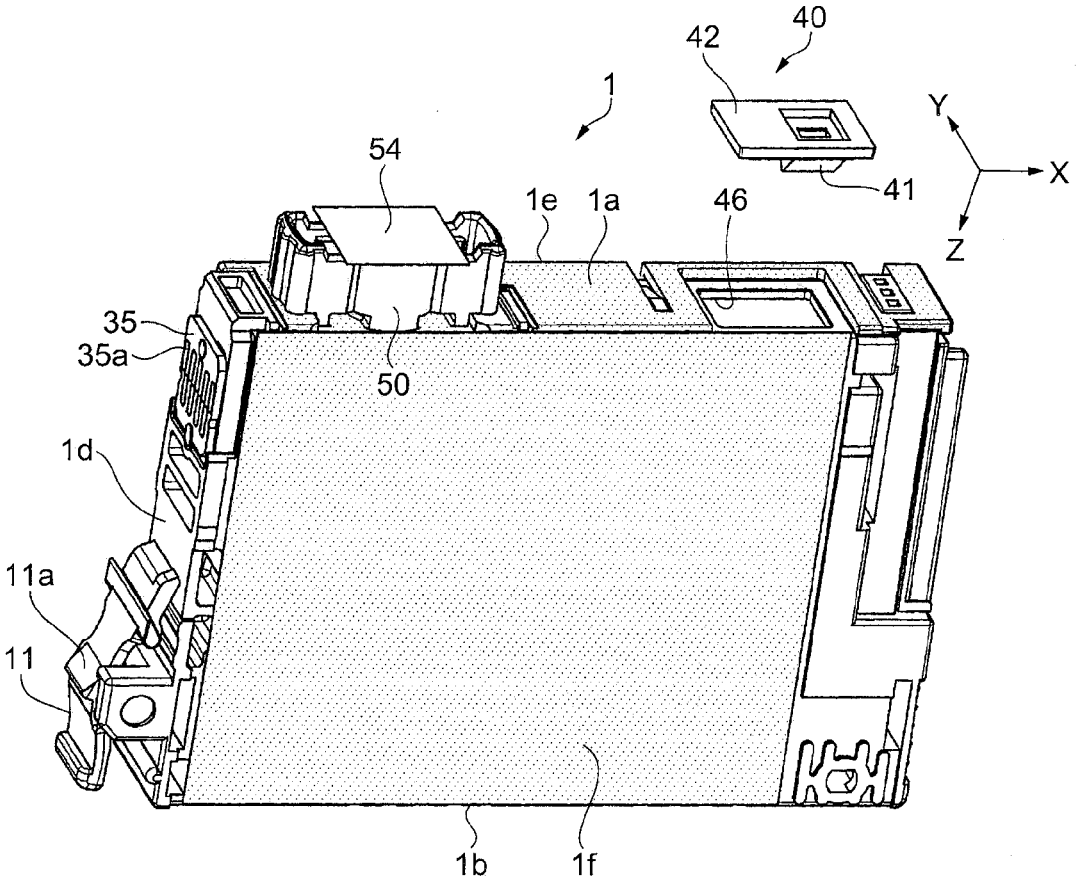
FIG. 5A is an external perspective view of an ink cartridge during ink refilling in a third embodiment.

FIG. 5A is an external perspective view of the ink cartridge 1 during ink refilling in the third embodiment. As illustrated in FIG. 5A, in the third embodiment, the prism unit 40 is removed from the bottom surface 1*b* of the ink cartridge 1. Also, an opening part 46 is formed at a location of the bottom surface 1*b* from which the prism unit 40 has been removed.

When the ink cartridge 1 is being refilled with ink, for example, a tube for ink injection is inserted into the opening part 46 formed in the bottom surface 1*b*. The inside of the ink cartridge 1 is filled with ink by injecting the ink into the ink holding chamber 110 from the opening part 46.

Figure 5B:
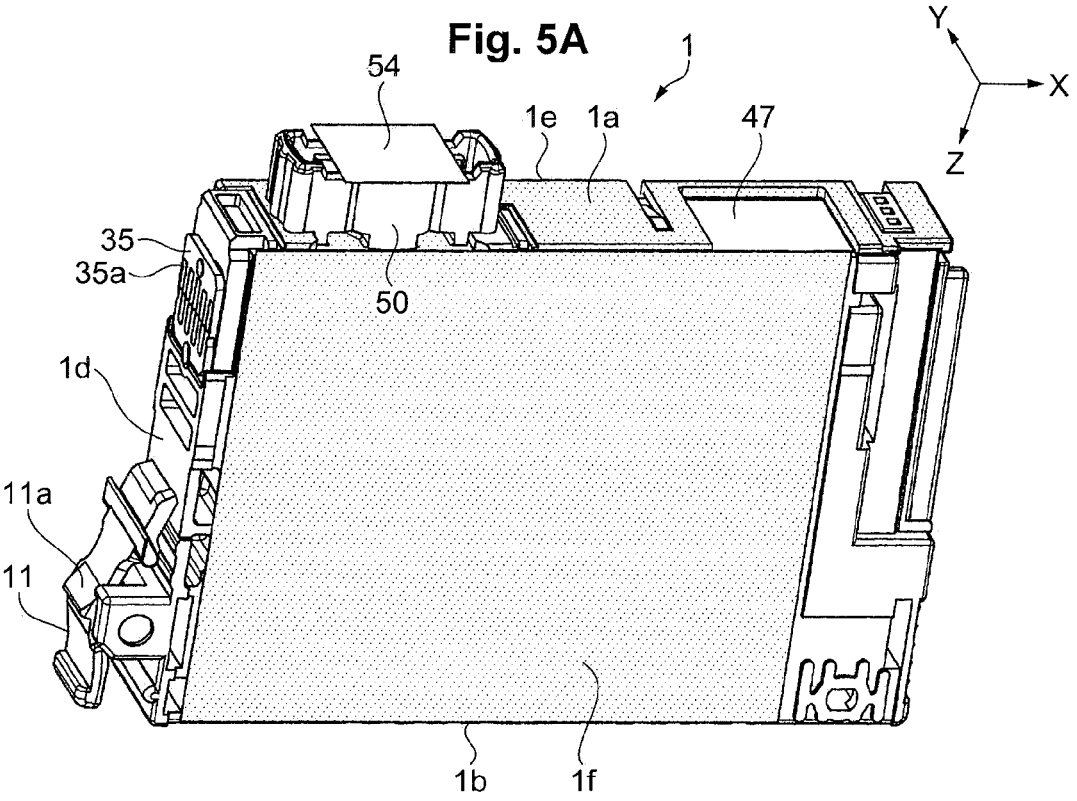
FIG. 5B is an external perspective view of an ink cartridge with a sealed opening part in a third embodiment.

When the refilling of the ink cartridge 1 with the ink is concluded, as illustrated in FIG. 5B, a sealing film 47 is welded from the outside onto the opening part 46 formed in the bottom surface 1*b* to thereby seal same. This makes it possible for the opening part 46 to be reliably sealed, and possible for the ink to be refilled a plurality of times, by again removing the sealing film 47 from the opening part 46.

In the embodiment described above, the prism unit 40 which is used in order to detect the remaining ink amount status when the ink cartridge 1 is being refilled with the ink is removed. The ink cartridge 1 is refilled by injecting the ink from the opening part 46 after removal. At this time, a user who is carrying out the task of refilling the ink is able to visually check the status of the ink filling from the opening part 46. Herein, in the present embodiment, rather than the through hole 45 being formed by drilling or the like in the prism unit 40, as in the first and second embodiments, the prism unit 40 is removed from the ink cartridge 1 and the opening part 46 is formed. This makes easy accommodation possible, without the need to process the ink cartridge 1. It is also possible to prevent the occurrence of problems, such as clogging of the ink cartridge 1 due to entry of boring debris into the ink holding chamber 110, the boring debris being from when the through hole 45 is formed by drilling or the like.

The sealing member after refilling may be "translucent", or may be "black-colored". That is, there is no limitation, provided that [the color] allows for it to be determined that there is ink with an optical sensor provided to the inkjet printer side when an unused ink cartridge is being mounted onto the inkjet printer for printing. The word "black-colored" can also refer to a color in a color tone range where the denotation in the Lab color space is a radius-10 circumference and therewithin on the a*b* plane, with the L* being represented at 40 or lower.

First Modification Example

In the embodiments described above, the prism unit 40 serving as the translucent part is configured to be provided with the prism 41 serving as the first translucent part and the base part 42 serving as the second translucent part, the first translucent part and the second translucent part being in contact with each other. However, rather than the base part 42 being the second translucent part, the second translucent part may instead be provided to a location not in contact with the first translucent part, i.e., with the prism 41. For example, a translucent member whereby the inside of the ink holding chamber 110 can be viewed may be provided to a location facing the ink holding chamber 110 on the bottom surface 1*b* of the ink cartridge 1 (to a location different than the base part 42), to serve as the second translucent part. A translucent member whereby the inside of the ink holding chamber 110 can be viewed may also be provided to a location facing the ink holding chamber 110 on the right-side surface 1*c* or the front surface 1*e* of the ink cartridge 1, to serve as the second translucent part. Further, in the embodiments described above, the prism unit 40 (translucent part) was one which is used in order to optically detect the remaining ink amount status of the ink holding chamber 110, but also included are ones which are used in order to optically detect the presence of absence of ink in the ink holding chamber 110.

Second Modification Example

In the embodiments described above, the user who is carrying out the task of refilling the ink visually checks the status of the filling of the ink via the translucent portion of the prism unit 40. However, there is no limitation thereto, and the translucent portion of the prism unit 40 may be imaged by an imaging device such as a camera, from the exterior of the ink cartridge 1, and image processing may be carried out on the basis of the captured image for an automatic check of the status of the filling of the ink.

What is claimed is:

1. A method of refilling ink in an ink cartridge, the method comprising:

refilling the ink in the ink cartridge from a position at which a translucent part is provided in the ink cartridge, with the translucent part being used to optically detect an amount of the ink held in the ink cartridge, the translucent part having a first translucent part including a prism that is arranged such that a state of reflection of light incident from an exterior of the ink cartridge to the prism varies depending on the amount of the ink held in the ink cartridge, and a second translucent part including a plate-shaped base member to which the prism is attached, the second translucent part allowing light to pass through, wherein the ink cartridge has a through hole penetrating through the translucent part, and the refilling of the ink includes refilling the ink via the through hole.

2. The method of refilling ink as set forth in claim 1, wherein the ink cartridge has a plurality of ink holding chambers in which the ink is held, and the translucent part is provided in one of the ink holding chambers having the greatest volume among the plurality of the ink holding chambers.

3. The method of refilling ink as set forth in claim 1, wherein the through hole penetrates through the second translucent part.

4. The method of refilling ink as set forth in claim 1, further comprising:

sealing the through hole by a member that absorbs light after the refilling of the ink.

5. The method of refilling ink as set forth in claim 1, wherein the through hole penetrates through the first translucent part.

6. The method of refilling ink as set forth in claim 1, wherein the ink cartridge includes a black-colored material.

7. The method of refilling ink as set forth in claim 1, wherein the first translucent part and the second translucent part are not in contact with each other.

8. An ink cartridge refilled by the method of refilling ink as set forth in claim 1.

9. A method of manufacturing an ink cartridge refilled by the method of refilling ink as set forth in claim 1.

* * * * *